US009387692B2

(12) United States Patent
Palumbo

(10) Patent No.: US 9,387,692 B2
(45) Date of Patent: Jul. 12, 2016

(54) MACHINE FOR THE DECORATION OF TRIDIMENSIONAL PRODUCTS

(75) Inventor: Vincenzo Palumbo, Castellarano (IT)

(73) Assignee: PROJECTA ENGINEERING S.R.L., Fiorano Mondenese (Modena) (IT)

( * ) Notice: Subject to any disclaimer, the term of this patent is extended or adjusted under 35 U.S.C. 154(b) by 0 days.

(21) Appl. No.: 14/411,272

(22) PCT Filed: Jun. 29, 2012

(86) PCT No.: PCT/IB2012/053332

§ 371 (c)(1),
(2), (4) Date: Feb. 19, 2015

(87) PCT Pub. No.: WO2014/001850

PCT Pub. Date: Jan. 3, 2014

(65) Prior Publication Data

US 2015/0321486 A1 Nov. 12, 2015

(51) Int. Cl.

| | |
|---|---|
| ***B41J 23/00*** | (2006.01) |
| ***B41J 3/407*** | (2006.01) |
| ***B41J 3/54*** | (2006.01) |

(52) U.S. Cl.

CPC ..... *B41J 3/4073* (2013.01); *B41J 3/543* (2013.01)

(58) Field of Classification Search

None

See application file for complete search history.

(56) References Cited

U.S. PATENT DOCUMENTS

2001/0005942 A1 * 7/2001 Patton et al. ..... 33/18.1
2001/0019340 A1 * 9/2001 Kubo et al. ..... 347/1

FOREIGN PATENT DOCUMENTS

EP 0993903 A2 4/2000
JP 05318715 A * 12/1993 ..... B41J 2/01

OTHER PUBLICATIONS

International Search Report dated May 3, 2013 for International Application No. PCT/IB2012/053332.

* cited by examiner

*Primary Examiner* — Bradley Thies
(74) *Attorney, Agent, or Firm* — Tutunjian & Bitetto, P.C.

(57) ABSTRACT

A machine for the decoration of tridimensional products, including a basement, means for supporting the product to be decorated associated to the basement and a unit for decorating the product associated to the basement. The decoration unit includes a moveable arm rotatably associated to the basement, a plurality of print heads of the ink-jet type, provided with at least one head with ejector nozzles, sliding along the moveable arm. Each of the print heads is moveable from a non-operating position, in which it is spaced from the product, to an operating position in which it is in proximity of the surface of the product, to obtain a decoration.

7 Claims, 2 Drawing Sheets

MACHINE FOR THE DECORATION OF TRIDIMENSIONAL PRODUCTS

TECHNICAL FIELD OF THE INVENTION

The present invention regards a machine for the decoration of tridimensional products.

More in particular, the present invention regards a machine for the decoration of tridimensional products such as plates, bowls, trays, and the like.

STATE OF THE PRIOR ART

In the industry for the decoration of tridimensional products such as plates, bowls, trays and the like, there are used industrial lines in which there are applied conventional techniques such as pad printing, screen printing, and the like.

More generally, such products are generally decorated on lines which provide for the use of tools, for example pads or the like, adapted to impress on the surface of the plate a given decorative pattern, distinguished by give colour tones.

The main advantage deriving from the use of this type of lines lies in the high productivity, given that such lines are capable of managing high amounts of products; the use thereof is thus convenient in case of large scale production.

On the contrary, the aforementioned production lines are definitely rigid and thus poorly versatile, given that obtaining a modification, even the least, of the decorative pattern applied on the products usually requires replacing mechanical parts, i.e. typically the tools—for example pads or the like—which apply the colour on the surface of the products to be decorated. Hence, each time there arises the need to vary, for example, the pattern to be provided on the products, or the format of the products, or even other production parameters there arises the need to suspend the production over the period of time required to replace the mechanical parts directly involved in the provision of the decorations, the possible adjustments and calibration and tests of the aforementioned mechanical parts, and even other operations.

In addition it should be observed that these conventional decoration lines, due to the very nature of the decorative means used, are not suitable to obtain results distinguished by high graphic quality and satisfactory repeatability of results.

In other words, the results that can be obtained using these lines do not always meet the variable market needs observable in this market in terms of quality and precision as well as repeatability of the decorations.

SUMMARY OF THE INVENTION

Thus, the technical task of this invention is to improve the state of the art.

Within such technical task, an object of the present invention is to provide a machine for the decoration of tridimensional products that is extremely versatile to use, in terms of decorative patterns that can be used, with respect to the conventional decoration lines.

Another object of the present invention is to provide a machine for decorating tridimensional products that allows obtaining results having a greater quality and thus more repeatable with respect to those that can be obtained using conventional decoration lines.

This task and object are attained by the machine for the decoration of tridimensional products according to aspects of the present principles.

The machine according to the invention is provided with a decoration unit comprising a moveable arm to which print heads of the ink-jet type are slidably associated. The degrees of freedom conferred by the rotation of the moveable arm and by the translation of the print heads along the aforementioned arm in relation to the type of product and to the surface area in which the decoration is to be provided allow obtaining on the products, according to infinite graphic and colour combinations, decorative patterns having quality and repeatability considerably higher than those that can be obtained using the conventional lines.

The present invention includes a decoration method that can be implemented using the machine according to the invention.

The present description includes preferred and advantageous embodiments of the invention.

BRIEF DESCRIPTION OF THE DRAWINGS

The characteristics of the invention shall be clearer for those skilled in the art from the description that follows and from the attached drawings, provided by way of non-limiting example, wherein.

DETAILED DESCRIPTION OF THE INVENTION

Figure 1:
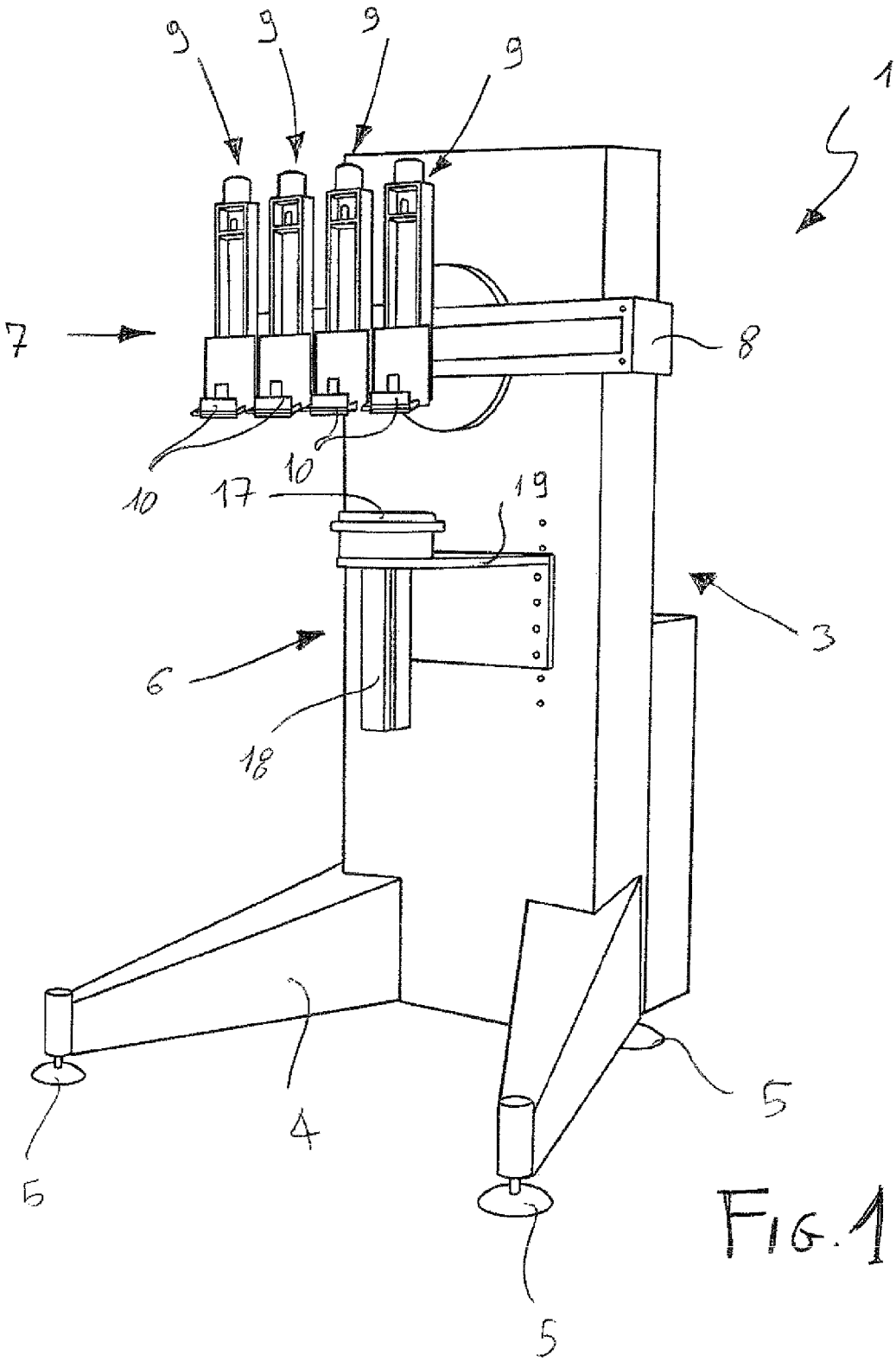
FIG. 1 is a perspective view of the machine according to the invention.

With reference to the attached FIG. 1, a machine for the decoration of tridimensional products according to the present invention is indicated in its entirety with 1.

The machine is suitable for the surface decoration of tridimensional products such as plates, bowls, trays and the like, of any shape and dimension, for example made of ceramic material but also other materials, without any limitation.

However the machine could also be used for the surface decoration of other types of tridimensional products such as bottles, drinking glasses, vials, and the like.

Furthermore, the machine 1 described hereinafter is indistinctively suitable to operate autonomously, or be inserted in a more complex line for the decoration of products, in which it may constitute one of the various production stations.

The machine, in other words, is extremely versatile to use in a plurality of applications for the decoration of products.

Figure 3:
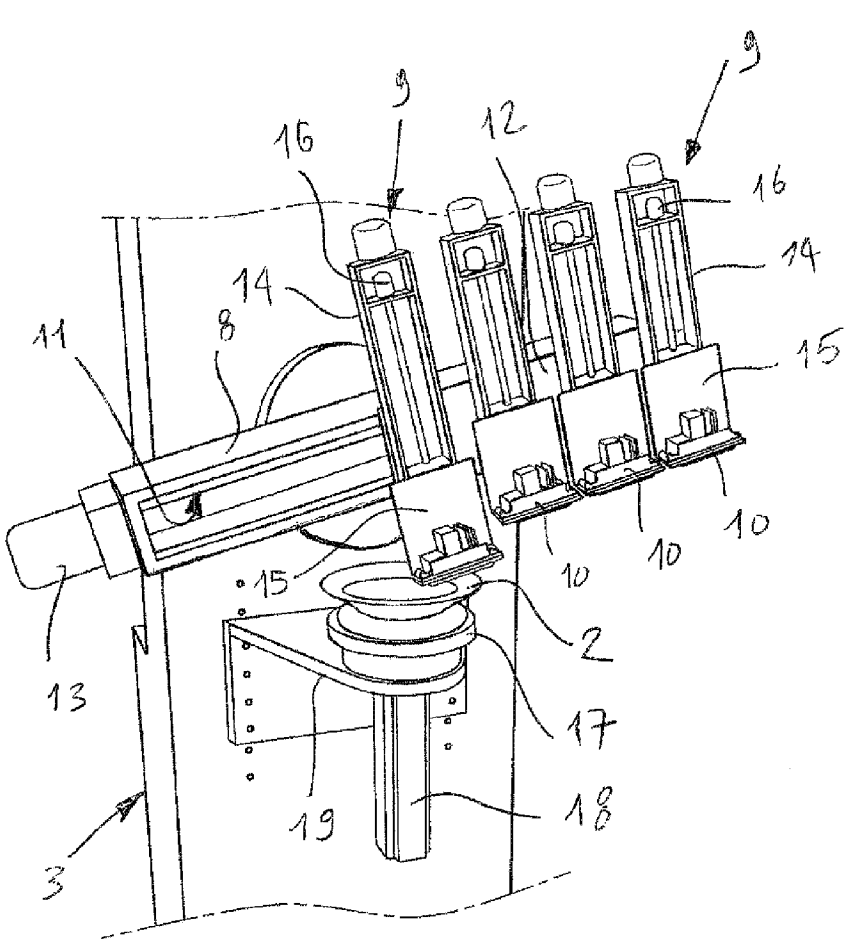
FIG. 3 is a perspective view of a detail of the machine according to the invention in a further operating step.
Figure 2:
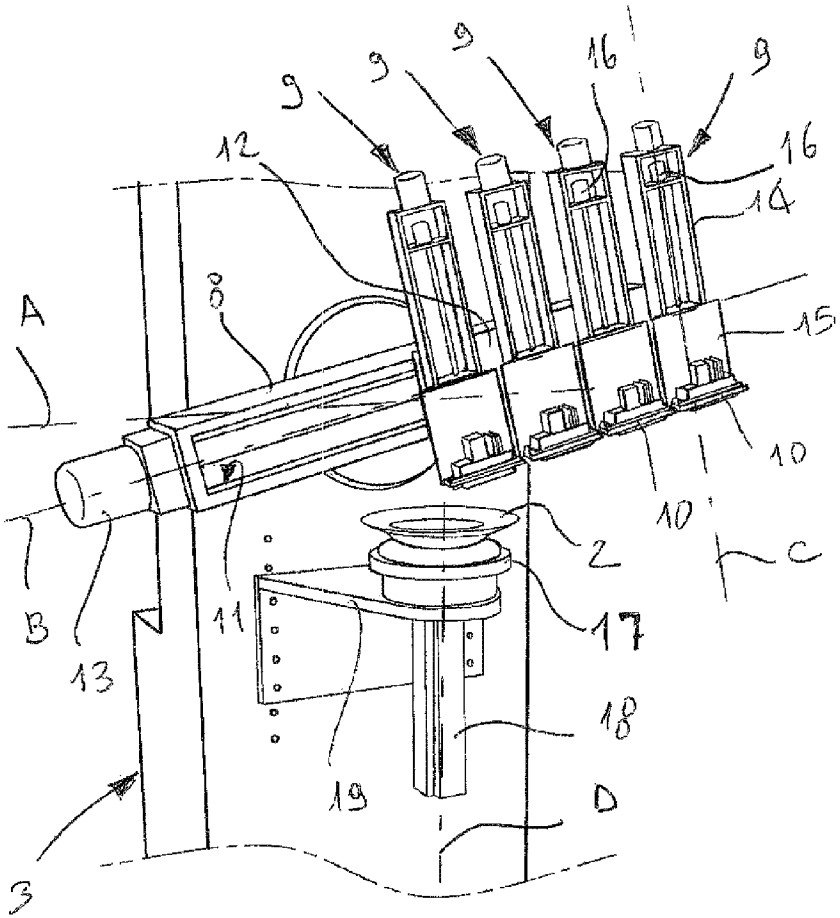
FIG. 2 is a perspective view of a detail of the machine according to the invention in an operating step thereof.

In FIGS. 1-3 the product 2 to be decorated is constituted, solely by way of example, by a plate.

However, as mentioned the product 2 could be of any other type, for example it could be a bowl, a tray, or even a drinking glass, a bottle, more generally any tridimensional product whose surface is to be decorated according to a given pattern.

It should be observed that the machine 1 could also operate on flat or two-dimensional products such as panels, tiles, and the like, but, as clearly observable hereinafter in the description, the most advantageous application thereof occurs in tridimensional products 2.

The machine 1 comprises, in a per se known manner, a basement, indicated in its entirety with 3.

The basement 3 comprises, more in detail, a base 4 with feet 5, for example adjustable.

As observable in FIG. 1, the basement 3 of the machine 1 according to the invention has a substantially vertical development, so as to obtain a structure that is light, compact and with minimum overall dimensions.

The machine 1 comprises support means, indicated in their entirety with 6, for the product 2 to be decorated, associated to the basement 3.

The machine 1 further comprises a decoration unit, indicated in its entirety with 7, the latter also associated to the basement 3.

The machine also comprises a processing and control unit, not represented in the figures, which manages the overall operation of the machine.

The means 6 for supporting the product and the decoration unit 7 are connected to the processing and control unit, according to the methods clarified hereinafter.

According to an aspect of the present invention, the decoration unit 7 comprises a moveable arm 8, rotatably associated to the basement 3.

The decoration unit 7 further comprises a plurality of print heads 9, sliding along the moveable arm 8.

The print heads 9 are of the ink-jet type.

In other words, each print head 9 comprises one or more respective heads 10 each provided with nozzles for ejecting a print fluid, not shown in the figures but of the known type.

The print fluid dispensed by the heads 10 may be constituted, for example, by ink of a given colour.

Alternatively the print fluid dispensed by the heads 10 may be constituted by a glaze, or any other fluid suitable to be applied on the surface of a product 2 to obtain the decorative effect, or the like. In an embodiment of the machine, each print head 9 may be associated to a single colour; however, in other embodiments, each print head 9 could be associated to more than one colour, for example mounting several heads 10 on the same print head 9.

Generally, the heads 10 are of the type suitable to dispense a controlled amount, over the unit of time, of micro-drops of a print fluid—for example ink—intended to be deposited on the surface of the product 2 to be decorated.

In any case, the heads 10 are of the type per se known in the products decoration industry, and they shall not be described further in detail regarding the structure and operation thereof.

Obviously the type of head 10 may be varied depending on the specific application to be provided.

For example, the heads 10 already available in the market as commercial components and which should thus be solely mounted on the print heads 9, can be used.

Also the means for the electronic control of the operation of each of the heads 10 are of the type known in the ink-jet printing industry, and they shall not be described further in detail.

In an embodiment of the machine 1 according to the invention, the heads 10 may be associated to a respective recirculation system of the print fluid, which maintain the same fluid in optimal conditions for the application thereof on the surface of the product 2 to be decorated.

As better clarified hereinafter, each of the print heads 9 is moveable from a respective non-operating position—illustrated in FIGS. 1 and 2—in which it is spaced from the product 2, to a respective operating position—illustrated in particular in FIG. 3—in which it is instead in proximity of the product 2 to obtain a decoration on the surface thereof.

The print head 9—i.e. in particular the head 10 associated thereto may be arranged, in the aforementioned operating position, at a distance of a few millimeters from the surface of the product 2, for example typically 2-3 millimeters, or even lower.

Obviously the operating position of each print head 10 with respect to the surface of the product 2 may be suitably varied depending on the various needs, for example depending on the result to be obtained.

Each print head 9, in the aforementioned operating position, provides, on the surface of the product 2, a given pattern of a given colour, or even more than one colour, should several heads 10 be mounted on the same print head 9.

The combination of the single decorative patterns provided by the various print heads 9 generally provides, on the surface of the product 2, a complex and polychromatic decorative pattern with high quality and repeatability, as clarified hereinafter.

The moveable arm 8 is rotatably associated to the basement 3 according to a rotation axis A.

The moveable arm 8 has its own longitudinal axis B.

The rotation axis A is perpendicular to the longitudinal axis B of the moveable arm 8.

In other words, the moveable arm 8 is rotatable in a plane parallel to the front surface of the basement 3.

The machine 1 comprises means for actuating the moveable arm 8 from a non-operating position—in particular the one illustrated in FIG. 1—to a plurality of operating positions—one of these is illustrated in FIGS. 2, 3—in which it is inclined with respect to the means 6 for supporting the product 2, as clarified hereinafter.

The means for actuating the moveable arm 8—not illustrated in the figures—may be constituted, for example, by a gearmotor unit, operatively connected to the processing and control unit of the machine.

The aforementioned gearmotor unit has an output axis which, in the represented embodiment, is horizontal, or substantially horizontal; the moveable arm 8 is connected to the aforementioned output axis, for example at the centreline point thereof.

The moveable arm 8 comprises a longitudinal sliding guide 11.

The print heads 9 are associated to the sliding guide 11, as better described hereinafter.

The sliding guide 11 of the moveable arm 8, more in detail, is constituted by a groove provided in the front surface of the arm 8; obviously, the sliding guide 11 could also be of any other type, for example it could be constituted by projecting profiles provided on the outer surface of the arm 8.

In the embodiment illustrated in FIGS. 1-3, the print heads 9 are mounted on a single slidable carriage 12, associated to the sliding guide 11.

More in detail the carriage 12 may be provided, for example, with wheels which slide within the guide 11, or it may be provided with other equivalent means for sliding within the guide 11.

The moveable arm 8 comprises means 13 for translating the print heads 9 along the sliding guide 11.

More in detail, the translation means 13 are associated to the carriage 12 to which the print heads 9 are associated in turn.

The translation means 13 are operatively connected to the processing and control unit of the machine 1. The translation means 13 are constituted, for example, by a controlled axis which moves the carriage 12 along the guide 11, and i.e. along the longitudinal axis B of the moveable arm 8.

More in detail, the translation means 13 may be constituted by a gearmotor unit associated to a screw engaged in a respective nut screw provided for in the carriage 12.

Alternatively, the gearmotor unit of the translation means 13 may be associated to a toothed belt meshing with a toothed wheel provided for in the carriage 12.

More generally, the translation means 13 may be of any other type suitable to displace the print heads 9 along the guide 11 in an extremely accurate manner, without any limitation and depending on the specific application requirements.

As illustrated in FIG. 3, the print heads 9 are moveable, from the respective non-operating positions to the respective operating positions and vice versa, according to respective translation directions C parallel to each other, and perpendicular to the longitudinal axis B of the moveable arm 8.

The aforementioned translation directions C, of the print heads 9, are perpendicular to the rotation axis A of the moveable arm 8, as illustrated in FIG. 2.

In other embodiments of the machine according to the invention, the rotation axis A of the moveable arm 8, the longitudinal axis B of the arm 8 and the translation directions C of the print heads 9 from the non-operating positions to the operating positions could be arranged differently and in a manner suitable for the specific application needs, for example to meet given requirements regarding the overall dimensions or spatial orientation requirements of the components.

Each of the print heads 9 comprises a fixed portion 14, associated to the sliding guide 11, and a portion 15 moveable bearing one or more heads 10 with a plurality of ejector nozzles.

The moveable portion 15 of each print head 9 may translate along the respective translation direction C. More in particular, each print head 9 comprises a respective unit 16 for translating the moveable portion with respect to the fixed portion 14 along the translation direction C.

Each unit 16 for translating the respective print head 9 is operatively connected to the processing and control unit of the machine 1.

Each translation unit 16 may be of any type: for example, it may be constituted by a gearmotor unit associated to a screw which moves the moveable portion 15, or it may be of any other type, for example of the belt type, or the like.

Each print head 9 further comprises one or more reservoirs for the print fluid used for the decoration, or other means equivalent and known in the industry.

The means 6 for supporting the product 2 comprise, more in detail, a rotatable platform 17.

The platform 17 rotates around a vertical axis D, as illustrated in FIG. 2.

In other embodiments, the rotation axis of the rotatable platform 17 could be inclined by a given angle with respect to the vertical.

The platform 17 may be rotatable, around the vertical axis D, manually or using special rotation means 18 associated thereto.

The rotation means 18 may be constituted, for example, by a gearmotor group, coupled to the platform 17, and operatively connected to the processing and control unit of the machine.

In some particular embodiments of the machine according to the invention, the rotation means 18 may be of the type suitable to generate a motion of the rotatable platform 17 which develops according to a non-circular trajectory, for example elliptic or the like. Thus, this solution allows performing decorations on non-circular-shaped products 2.

The rotatable platform 17 may also be associated to means for holding the product 2, for example of the suction cup type, clamp type or the like.

The rotatable platform 17 is supported by a bracket 19 associated to the basement 3.

More in detail, the bracket 19 is adjustable height-wise manually or automatically, through suitable translation means not represented in the figures but of the known type.

In particular, the possibility of adjusting the height of the support means 6 with respect to the basement 3 allows adapting the machine so as to operate with products 2 even having extremely different shapes and dimensions.

The method for decorating a tridimensional product 2 using the machine according to the present invention is described hereinafter.

In a first operating step, the product 2 to be decorated is positioned on the support means 6 of the machine 1.

More in detail, the product 2 is positioned on the rotatable platform 17 and it is held on this position by holding means provided on the platform 17.

The product 2 may be positioned manually on the rotatable platform 17, or it may reach there due transport means, for example a conveyor belt or the like provided for; still alternatively, the product 2 may be positioned on the rotatable platform 17 by a robotic arm or by other similar positioning devices.

Subsequently the machine rotates the moveable arm 8, with respect to the support means 6 and i.e. with respect to the rotatable platform 17, by an angle substantially corresponding to the inclination of the surface of the product 2 to be decorated.

In the represented embodiment, given that the product 2 is in particular constituted by a plate, the moveable arm 8 is thus rotated by an angle substantially corresponding to the inclination of the internal surface of the plate with respect to the rotatable platform 17, which thus constitutes a horizontal reference.

Upon reaching this position of the moveable arm 8, the machine translates, along the translation direction C, at least one of the print heads 9 from the respective non-operating position—FIG. 2—to the respective operating position—FIG. 3—in which it is positioned in proximity of the surface product 2 to obtain a given decorative pattern thereon.

In this condition, the plane on which the ejector nozzles of the head 10 lie is substantially tangential to the surface of the product 2 which is to be decorated.

In other words, the ejector nozzles of the head 10 are all substantially equally-spaced from the surface to be decorated, so as to prevent a non-uniform distribution of the print fluid on the surface.

At this point, the machine actuates the ejector nozzles of the head 10 of the aforementioned print head 9, over a given time range, so as to deposit—on the surface of the product 2—a given amount of print fluid, for example ink.

Regarding the specific decorative pattern to be provided, the operating steps of translating the print head 9 and actuating the ejector nozzles, described above, may be, for example, repeated several times using the same print head 9.

Should each print head 9 be associated to a respective colour, and should there arise the need to provide a polychromatic decorative pattern on the product 2, the machine translates the print heads 9—i.e. particularly the carriage 12 which supports them—along the longitudinal axis B of the moveable arm 8, so as to position each print head 9, or even only some of them, in succession at the surface of the product 2 to be decorated.

For example, should there arise the need to provide, on the product 2, a decorative pattern comprising all colours of the various print heads 9, to be applied according to a determined sequence, the translation means 13 of the carriage 12 perform a series of brief displacements of the carriage 12 along the longitudinal axis B of the moveable arm 8 so as to near—in the aforementioned sequence one after the other—the print heads 9 to the surface to be decorated.

This allows the print heads 9, one after the other and in the aforementioned sequence, to dispense the print fluid, through the respective heads 10, on the surface to be decorated according at the desired sequence.

The described method may be implemented to obtain a decorative pattern, for example polychromatic, at a determined portion of the surface of the product 2.

Decorative patterns may be obtained on other portions of the surface of the product by varying the inclination angle of the moveable arm 8, so as to direct the planes of the heads 10 differently.

Alternatively or combined therewith, the support means 6 can be rotated by a given angle, determined by the processing and control unit, so as to position the desired portion of the surface of the product 2 in the area most comfortable to be reached by the heads 10 of the decoration unit 7.

Should there arise the need to provide, for example, on a product 2 constituted by a plate or the like a circumferential decoration, the machine operating parameters should be set so that the selected head 10 of the print head 8 releases the print fluid uniformly over a given time range sufficient to allow the rotation means 18 to impart to the rotatable platform 17—and thus to the product 2—a complete rotation around the vertical axis D.

The operation may then be performed in sequence by other print heads 8 should there arise the need to provide a circumferential polychromatic decorative pattern.

It has thus been observed that the invention attains the proposed objects.

The decorating machine according to the present invention allows providing—on the tridimensional products—decorations, even polychromatic and complex, with quality considerably higher than that which can be obtained using the conventional decoration lines, but with production costs lower than those of the aforementioned conventional lines.

Furthermore, the decorations that can be obtained using the machine according to the present invention are distinguished by greater accuracy and repeatability with respect to those provided using the conventional lines.

The machine according to the present invention can be used in an extremely versatile manner with respect to the conventional decoration lines, given that they do not require any replacement or adjustment intervention regarding the mechanical parts to obtain different decorations or to obtain decorations on products with different shape or dimensions.

Actually, the use of ink-jet print heads, accurately controlled by the processing and control unit of the machine, allows obtaining—on the surface of the products—infinite graphic solutions and infinite chromatic combinations without any intervention to adjust or replace the parts.

A further but not less important advantage lies in the fact that the machine is simple and it is small in size, thus it can be easily inserted even in pre-existing lines; furthermore it can be made operative even without requiring specific technical skills, given that it is distinguished by few and simple movements.

The present invention has been described according to preferred embodiments, but equivalent variants may be conceived without departing from the scope of protection outlined by the claims that follow.

The invention claimed is:

1. A machine for the decoration of tridimensional products, comprising:

a basement;

a rotatable platform supported by a bracket connected to said basement for supporting the product to be decorated;

a decoration unit, for decorating the product, connected to said basement;

wherein said decoration unit comprises:

a moveable arm having a longitudinal axis (B) and being rotatably connected to said basement, wherein said moveable arm is rotatably connected to said basement according to a rotation axis (A) which is perpendicular to the longitudinal axis (B) of said moveable arm; and a plurality of print heads of the ink-jet type, provided with at least one head with ejector nozzles, slidable along said moveable arm, wherein each of said print heads being moveable, along a translation direction (C), from a non-operating position, in which it is spaced from the product, to an operating position in which it is in proximity of the product to obtain a decorative pattern, wherein said translation direction (C) of said print heads are parallel to each other and perpendicular to said longitudinal axis (B) of said movable arm and perpendicular to said rotation axis (A) of said movable arm, and wherein the moveable arm is rotatable in a plane parallel to at least a surface of the basement connected to the bracket which supports the rotatable platform.

2. The machine according to claim 1, wherein said moveable arm comprises a longitudinal sliding guide to which said print heads are associated.

3. The machine according to claim 2, wherein said moveable arm comprises means for translating said print heads along said sliding guide.

4. The machine according to claim 3, wherein said print heads are mounted on a single slidable carriage associated to said sliding guide, to which said translation means are associated.

5. The machine according to claim 2, wherein each of said print heads comprises a fixed portion associated to said sliding guide, and a portion moveable along the respective translation direction (C) and bearing said head with ejector nozzles.

6. The machine according to claim 1, wherein said bracket is adjustable height-wise manually or automatically.

7. The machine according to claim 1, comprising means for actuating said moveable arm from a non-operating position to a plurality of operating positions in which it is inclined with respect to said rotatable platform by an angle substantially corresponding to the inclination of the surface of the product to be decorated.

* * * * *